United States Patent [19]

Spahr

[11] Patent Number: 5,052,185

[45] Date of Patent: Oct. 1, 1991

[54] ICE CHEST RACK SYSTEM

[76] Inventor: William Spahr, P.O. Box 127, Des Allemands, La. 70030

[21] Appl. No.: 601,294

[22] Filed: Oct. 22, 1990

[51] Int. Cl.[5] ..... B65B 63/08

[52] U.S. Cl. ..... 62/60; 62/457.7; 62/372; 62/465

[58] Field of Search ..... 62/457.1, 457.7, 371, 62/372, 459, 464, 465, 60

[56] References Cited

U.S. PATENT DOCUMENTS

| | | | |
|---|---|---|---|
| 416,356 | 12/1889 | Clark . | |
| 594,413 | 11/1897 | Medbery et al. . | |
| 1,074,453 | 9/1913 | Park . | |
| 1,186,418 | 6/1916 | Mischo . | |
| 1,745,556 | 2/1930 | Pendleton . | |
| 1,782,720 | 11/1930 | Franklin . | |
| 3,636,888 | 1/1972 | Angelback, Jr. | 108/51 |
| 3,707,929 | 1/1973 | Lauffer | 108/51 |
| 4,265,095 | 5/1981 | McConachie | 62/373 |
| 4,424,687 | 1/1984 | Morgan | 62/457 |
| 4,515,421 | 5/1985 | Steffes | 312/351 |
| 4,551,988 | 11/1985 | Petrantoni | 62/457.1 |
| 4,565,074 | 1/1986 | Morgan | 62/457 |

*Primary Examiner*—Albert J. Makay
*Assistant Examiner*—John Sollecito
*Attorney, Agent, or Firm*—C. Emmett Pugh

[57] ABSTRACT

An ice box rack designed to keep the stored food and other items dry, while slowing the melting of the ice. The preferred embodiment of the present invention teaches an ice box rack sized and configured to fit the container of a variety of currently sold ice chests, the rack including as a novel and unique feature a planar lower surface to facilitate the uniform application of compressive pressure on the ice. It has been found that this uniform pressure acts to pack the ice, particularly crushed or chipped ice, causing it to melt less quickly, thereby prolonging the cooling process. The present invention may be configured in a variety of different ways, and may be constructed of a number of different materials, including extruded or molded plastics, wood, aluminum, or the like, all with satisfactory results. Further, the rack design of the present invention may be configured to support a variety of differently configured items, such as unpackaged or packaged foods, can beverages, bulk items, etc.

1 Claim, 1 Drawing Sheet

ICE CHEST RACK SYSTEM

BACKGROUND OF THE INVENTION

1. Field of Invention

The present invention relates to accessories for ice boxes, chests, and the like and more particularly to an ice chest rack designed to keep stored food and other items dry, while slowing the melting of the ice.

The preferred embodiment of the present invention teaches an ice box rack, sized and configured to fit the container of a variety of currently sold ice chests, the rack including as a novel and unique feature a planer lower surface to facilitate the uniform application of pressure on the ice. It has been found that this uniform pressure acts to pack the ice, particularly crushed or chipped ice, causing it to melt less quickly, thereby prolonging the cooling process.

The present invention may be configured in a variety of different ways, and may be constructed of a number of different materials, including extruded or molded plastics, wood, aluminum, or the like, all with satisfactory results.

Further, the rack design of the present invention may be configured to support a variety of differently configured items, such as unpackaged or packaged foods, can beverages, bulk items, etc.

2. Prior Art General Background

As may be determined by a review of the below cited patents, the prior art has failed to contemplate an ice box accessory such as that contemplated by the present invention, that is, a rack/item support system incorporating a planer undersupport surface specifically designed for providing uniform weight distribution upon ice for packing it in uniform fashion, slowing its melting, and thereby increasing the period of cooling for a single load of ice.

A list of prior patents which may be of interest is presented below:

| Patent No. | Patentee(s) | Issue Date |
|---|---|---|
| 416,356 | Clark | 12/03/1889 |
| 594,413 | Medberry & Gurney | 11/30/1897 |
| 1,074,453 | Park | 09/30/1913 |
| 1,186,418 | Mischo | 06/06/1916 |
| 1,745,556 | Pendleton | 02/04/1930 |
| 1,782,720 | Franklin | 11/25/1930 |
| 3,636,888 | Angelbeck, Jr. | 01/25/1972 |
| 3,707,929 | Lauffer | 01/02/1973 |
| 4,265,095 | McConachie | 05/05/1981 |
| 4,424,687 | Morgan | 01/10/1984 |
| 4,515,421 | Steffes | 05/07/1985 |

Most of the above cited patents contemplate old refrigeration designs and related items, pallet designs, and the like, none of them contemplating the apparatus or method of the present invention.

In addition to the above cited patents, the prior art search indicated three patents relating to ice chest accessories, again all clearly distinguishable for reasons cited below.

U.S. Pat. No. 4,424,687 to Morgan teaches an "Ice Rack for use in Portable Ice Chest", teaching a "rack or platform standing above the bottom of the ice chest". The '687 reference goes on to teach the utilization of legs or upper support means to prevent communication of the ice or water with the main rack member, thereby keeping the food or stored item dry. The reference does not teach, however, the uniform packing of the ice, nor could such take place with the present patent, as it does not teach nor contemplate a planer support undersurface in relation to the upper rack member.

U.S. Pat. No. 4,565,074, also to Morgan, teaches an "Ice Tray" for use with a portable ice chest, the try comprising a "set of feet" which supports a "horizontal member in an elevated position", or, in an alternative design, the tray rests on "a set of raised transverse members integrally formed in the bottom of the ice chest".

Again, while the above designs may support stored items and keep them relatively dry when used accordingly, they do not provide uniform pressure to the ice for compressing it and thereby decreasing the rate of melting.

Lastly, U.S. Pat. No. 4,515,421 teaches a "Multiple Use Shelf for Cooler", teaching an ice chest shelf mounted in a variety of configurations on the chest itself, never providing the structure and function of the present invention.

3. General, Summary Discussion of the Invention

The present invention provides a system not contemplated by the prior art, teaching a rack system which not only keeps the stored items dry, but also has been shown to slow the melting of the ice due to its unique design.

The prior art, while contemplating various standard rack designs, has failed to teach any accessory to effectively yet inexpensively in a non-refrigeration or insulation manner slow the melting of the ice.

The present invention in its preferred embodiment comprises a rack system sized and configured to fit within the refrigeration compartment of an ice chest or the like, providing a dry storage area separated from the ice and water associated therewith.

The preferred embodiment of the present invention comprises a rack design having upper support members, one or more spacing members to elevate the upper support members, and a somewhat flat, lower planer area designed and configured to provide evenly distributed, compressive pressure upon the ice with which it communicates.

An alternative embodiment of the present invention teaches a support system without the spacing members, while still another embodiment teaches a rack system primarily designed to exert even pressure upon the ice, but without the lower planer area.

It is thus an object of the present invention to provide a system for storing items in a ice chest or the like in such a manner as to keep the stored item relatively dry, and further, in such a manner as to slow the melting of the ice.

It is a further object of the present invention to provide an accessory for use in con]unction with a variety of off-the-shelf ice chests which may be used for prolonging the cold storage period of same.

It is a further object of the present invention to provide a system for storing items in an ice chest or the like in such a manner as to keep the stored items, namely seafood and the like, from becoming soggy in the melted ice and loosing its flavor.

Lastly, it is an object of the present invention to provide an ice box accessory in the form of an ice box rack assembly which is designed primarily for supporting objects to be kept cool while preventing them from becoming wet, while at the same time, evenly compressing chopped or granular ice in such a manner as to slow the melting process.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EXEMPLARY EMBODIMENT(S)

Figure 1:
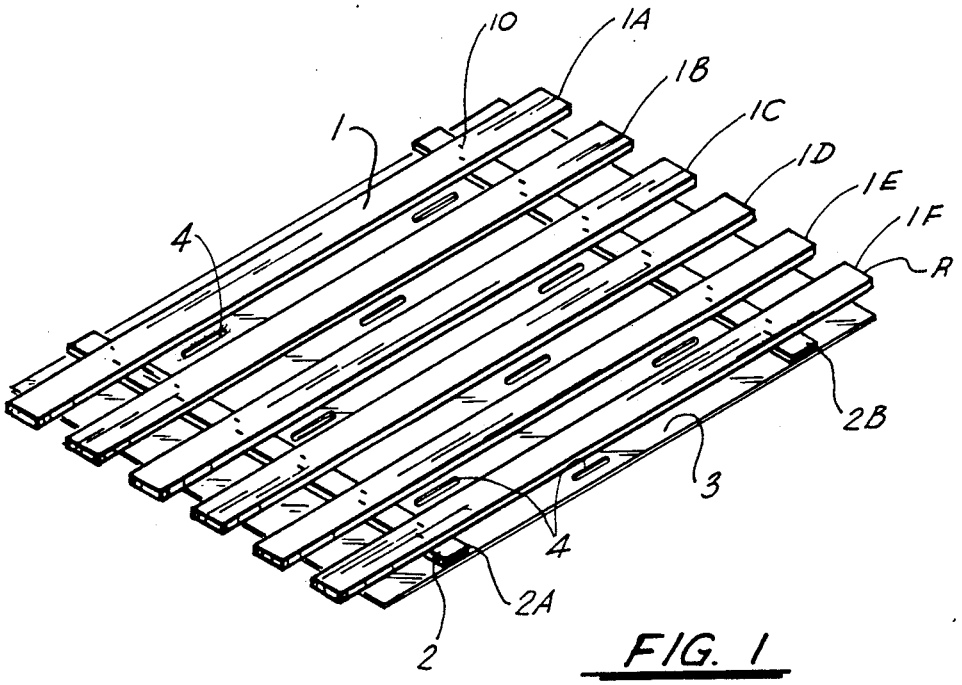
FIG. 1 is an top, isometric view of the preferred embodiment of the Ice Chest Rack System of the present invention.

As can be seen in FIG. 1, the Ice Chest Rack System R of the preferred, exemplary embodiment of the present invention, comprises a plurality of upper support slats 1 *a–f* mounted in parallel fashion, uniformly perpendicular to middle support slats 2 *a b*.

In the exemplary embodiment of the present invention, the upper slats 1 *a–f* are approximately two inches wide, twenty four inches long, and spaced one inch apart. The lower slats 2 *a b* are mounted parallel and evenly spaced relative to the upper support slats, in the exemplary embodiment, approximately eighteen inches apart. The upper and lower slats may be joined via nails 10, hot glue, or the like.

Sized and configured to support a lower area equal to that of upper slats 1 *a–f*, is planer support surface 3 which is joined to lower slats 2 A and B. In the exemplary embodiment of the present invention, planer support surface 3 includes drain ports 4 to allow for drainage of the stored items into the ice area, or to allow melted ice water to rise under the upper slat area 1.

Figure 2:
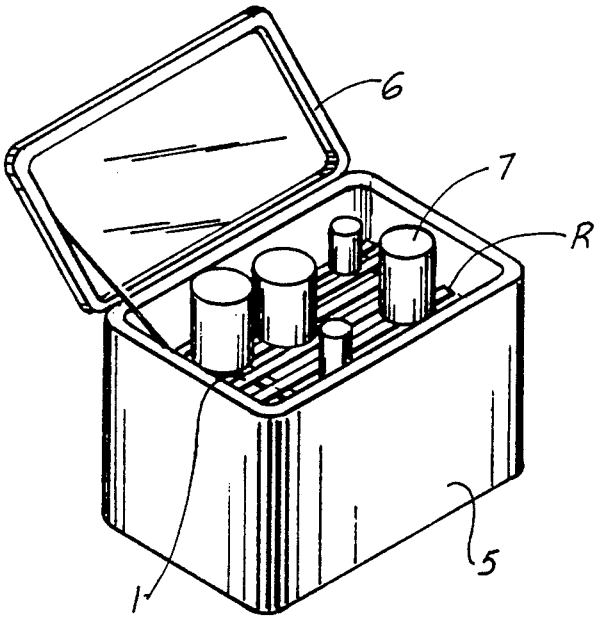
FIG. 2 is a top, isometric view of the Ice Chest Rack System installed in an exemplary Ice Chest, and having canned items placed thereupon.
Figure 3:
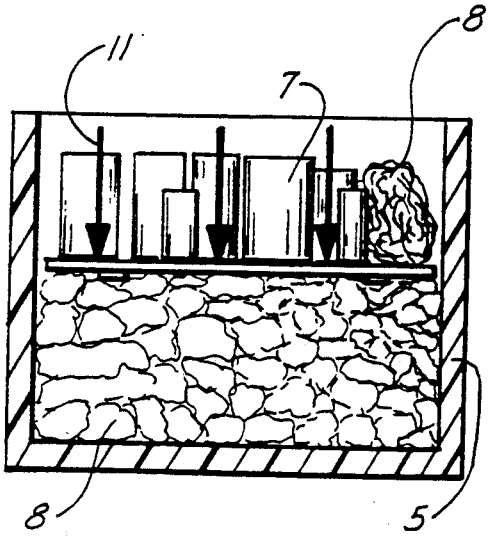
FIG. 3 is a side view of Ice Chest Rack System of FIG. 2, illustrating the placement of the Ice Rack relative to the items to be cooled, the ice, and the ice box, and also indicating via arrows the force applied upon the ice.

FIGS. 2 & 3 illustrate an exemplary use of the present invention in conjunction with a standard, off-the-shelf ice chest configuration 6. In use, the rack R is placed over the ice 8 such that the planer support surface 3 is in communication with the ice 8. Food items 7 such as those illustrated are placed atop the rack such that they communicate with the upper slats 1, the weight applying force 11 which is transmitted to planer support surface 3 with compressive pressure to ice 8.

The present invention has been found to work best with granular, chopped ice, or ice cubes, as the weight applied by the food items 7, 8 in conjunction with the insulation properties of the ice chest prolongs the cooling process by fusing the separate ice parts into a single ice piece. Thus, with the present invention, a single ice load will keep the chest cool longer than a comparable system without the present invention.

While the exemplary embodiment of the present invention is fabricated of wood, it is noted that many other materials would be suitable for use, such as plastics and the like. The only limitation relates to the fact that the material should not be overly thermally conductive, as this would tend to melt the ice faster than an insulative material such as that used with the exemplary embodiment, and of course the material should be sturdy enough to support the weight of the stored items.

An exemplary rack, configured to fit within an ice chest or the like having a width of 24 inches and length of 36 inches, would be approximately 23.5 inches by 35.5 inches, with a depth of approximately 4 inches. Such a rack, if made of high density polyethelyne, would weigh approximately 3 pounds. It is the placement of the weight of the items to be stored which in effect "compresses" the ice, slowing the melting process.

The embodiment(s) described herein in detail for exemplary purposes are of course subject to many different variations in structure, design, application and methodology. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A method of decreasing the rate of melting of chopped ice, granulated ice, or ice cubes in an ice chest, comprising the following steps:

(a) providing an ice chest rack, comprising:

a plurality of upper slats arranged in parallel fashion, said upper slats having first and second ends, at least two lower slats engaged to said upper slats at said first and second ends of said upper slats, respectively, said lower slats being arranged in parallel fashion relative one another, a planer support surface engaged to said lower slats, said planer support surface configured to generally occupy generally a similar planer area to that established by said upper slats;

(b) placing an amount of granular ice, chopped ice, or ice cubes in an ice chest or combination thereof;

(c) placing said ice chest rack in said ice chest such that said planer support surface is in contact with said granular ice, chopped ice, or ice cubes or combination thereof;

(d) placing an amount of items having significant weight upon said upper slats of said ice chest rack; and (e) allowing and using the weight of said items to communicate through said ice chest rack to be evenly distributed by said planer support surface to said granular ice, chopped ice, ice cubes or combination thereof, compacting said ice, and slowing the rate of melting of said ice.

* * * * *